United States Patent [19]

Litzenberg

[11] 3,967,915

[45] July 6, 1976

[54] CENTRIFUGAL PUMP

[76] Inventor: David P. Litzenberg, 1528 Bryant Lane, Meadowbrook, Pa. 19046

[22] Filed: Jan. 27, 1975

[21] Appl. No.: 541,492

[52] U.S. Cl. ..... 415/209; 415/204; 415/DIG. 3; 415/219 C; 417/423 R; 415/104

[51] Int. Cl.[2] ..... F04D 29/44

[58] Field of Search ..... 415/219 C, 206, 204, 415/201, 104, 106, 209; 417/420

[56] References Cited

UNITED STATES PATENTS

| | | | |
|---|---|---|---|
| 1,669,581 | 5/1928 | Spencer | 415/209 |
| 2,452,274 | 10/1948 | Walters | 415/204 |
| 2,841,326 | 7/1958 | Davis | 415/206 |
| 2,844,100 | 7/1958 | Heinicke | 415/201 |
| 2,997,958 | 8/1961 | Heinicke | 415/201 |
| 3,085,741 | 4/1963 | Burkhardt | 415/204 |
| 3,191,851 | 6/1965 | Wood | 415/204 |
| 3,221,983 | 12/1965 | Trickler et al. | 415/204 |
| 3,238,880 | 3/1966 | Camac | 415/206 |
| 3,411,450 | 11/1968 | Clifton | 417/420 |

FOREIGN PATENTS OR APPLICATIONS

| | | | |
|---|---|---|---|
| 177,661 | 7/1953 | Austria | 415/201 |
| 1,071,888 | 12/1959 | Germany | 415/204 |

*Primary Examiner*—Henry F. Raduazo
*Attorney, Agent, or Firm*—Zachary T. Wobensmith, 2nd; Zachary T. Wobensmith, III

[57] ABSTRACT

A centrifugal pump is described having an improved and simplified construction of pump casing and impeller with easy adaptability of the components over a wide range of capacity, the pump casing preferably being of stamped sheet metal with welded inlet and outlet connections, preferably of pipe of selected sizes, the pump casing preferably being of circular, as opposed to volute, shape in transverse cross section and with an inserted cut water tongue or plate capable of ready accommodation in shape to different impellers for different selected heads or viscosities so that each size of casing can be employed over a wide range of inputs and of delivered heads or volumes.

9 Claims, 2 Drawing Figures

CENTRIFUGAL PUMP

BACKGROUND OF THE INVENTION

1. Field of the Invention

This invention relates to centrifugal pumps.

2. Description of the Prior Art

Many designs of centrifugal pumps have heretofore been proposed.

Centrifugal pumps, because of their simplicity, low cost and ability to operate under a wide variety of conditions are extensively used as fluid handling devices. Such pumps are adapted to operate under a variety of heads up to several thousand feet, will handle liquids even at elevated temperatures, and operate at speeds that are standard for electric motors. Such pumps also can be throttled at the discharge without building up excessive pressure or overloading the driving unit.

The type of centrifugal pump most commonly used by industry because of its variability is the volute type with a variant known as the diffuser type. The volute type pump has a progressively expanding spiral casing into which the impeller discharges, the casing being proportioned to produce substantially equal velocity flow around its circumference and to gradually reduce the velocity of the liquid as it flows from the impeller to the discharge connection thereby changing velocity head to pressure head.

In the diffuser type of pump, the runner is surrounded by gradually expanding passages in the casing, formed by stationary guide vanes, for changing the direction of flow and converting velocity head to pressure head before the liquid enters the volute. A more complete conversion of velocity head to pressure head is effected, with increase of efficiency but at added cost and complication of the structure. Accordingly, diffuser type pumps are not considered justified except in large high pressure pumps.

In the volute type pumps commonly employed the efficiency is not high even when the volute and impeller are perfectly mated, at the highest efficient design point.

It is a common practice within this segment of the pump industry for the manufacturer, for economic reasons, to build a minimum number of volutes and vary the performance of the pump by variations in the width and diameter of the impeller. This approach results in lower operating efficiencies and renders ineffective the concept of producing equal velocity flow around the circumference of the volute. Resort has been had to the use of diffusers as mentioned above to overcome the large loss in efficiency. Problems of variability arise since the impellers, at least in diameter, must be reasonably matched to the inside dimensions of the volute vanes.

In the volute type pump, also, provisions have beem made for using wider impellers but this results in large areas for fluid rotation with turbulence and high friction losses.

The almost universal practice in such pumps in the range of 1 to 10 horsepower, and higher, has been to employ cast volutes, usually with integral cast inlet and outlet connections.

It has also heretofore been proposed to employ, in place of volutes, casings of circular transverse cross section but these have had very low efficiencies and have only been used for small pumps.

The customary pump design employing a volute with increasing area from the cut water to the discharge for reduction of velocity and conversion to pressure leaves much to be desired in practical applications and from the basic design viewpoint. The gradually increasing area in the volute is not required from the standpoint of flow since an examination of the performance curves for such pumps makes it clear that as the head increases the flow decreases so that such area increase is not required.

From the standpoint of efficiency of hydraulic flow and conversion of energy the utilization of a casing which does not increase in area is advantageous. The use of a concentric or circular casing has other benefits from the standpoint of manufacturing design, cost of construction, and utilization of materials of construction that are either expensive or difficult to obtain in forms that would be used in castings. Additional advantages follow from the use of concentric and symmetrical casings in permitting the use of manufacturing procedures employing standard machine tools, and from the strength advantage in having pressure stresses distributed equally on the casing.

The present invention departs from prior structures in that, in order to obtain greater efficiencies in the use of a circular casing, an inserted cut water plate or tongue is employed readily shaped as desired and required which not only has the periphery of the impeller running close to one portion but has portions disposed along the sides of the impeller substantially to the wearing ring with sufficient clearances to prevent interference in operation of the impeller. The cut water plate or tongue can be readily matched in manufacture to the width and diameter of the impeller thereby reducing the number of casing sizes required for a wide range of impeller sizes and providing greater versatility for casing utilization. The use of such a cut water plate or tongue in eccentric or volute casings will also improve the efficiencies of pumps of that type.

SUMMARY OF THE INVENTION

In accordance with the invention a centrifugal pump is provided with an improved pump construction including adaptability of pump casing to pump impeller, and variability therein to desired operating conditions, a circular or concentric pump housing preferably being employed, which may be of sheet metal and stamped or forged to shape, and which inludes a cut water tongue or plate which is readily mounted within the casing and which has a cut-out shaped to a selected impeller with the periphery of the impeller running in close relation and which extends along the sides of the impeller, the structure of casing, cut-water tongue or plate and impeller effecting more efficient conversion of velocity into pressure head, directing the pumped fluid into the discharge connection in a more effective manner, reducing turbulence and excessive flow with resultant friction within the pump casing by preventing rotation of the fluid within the casing.

It is the principal object of the invention to provide an improved centrifugal pump of increased efficiency which can be readily and inexpensively constructed.

It is a further object of the invention to provide a centrifugal pump or simplified construction of pump casing, inlet and delivery connections, and impeller, with capabilities of variation of pump characteristics as desired by change of minor components.

It is a further object of the invention to provide a centrifugal pump of the character aforesaid which includes an inserted cut water plate or tongue in the casing having a cut-out for clearance by the impeller, the shape of the cut-out being variable to accommodate impellers of different diameters and widths.

It is a further object of the invention to provide a centrifugal pump having a simplified pump casing which does not require casting but can be formed of sheet metal and with inlet and delivery pipes of the desired size, which can be standard pipe sizes, welded to the housing.

It is a further object of the invention to provide a centrifugal pump in which the pump structure can be easily changed to accommodate fluids of different specific gravity.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which.

Figure 1:
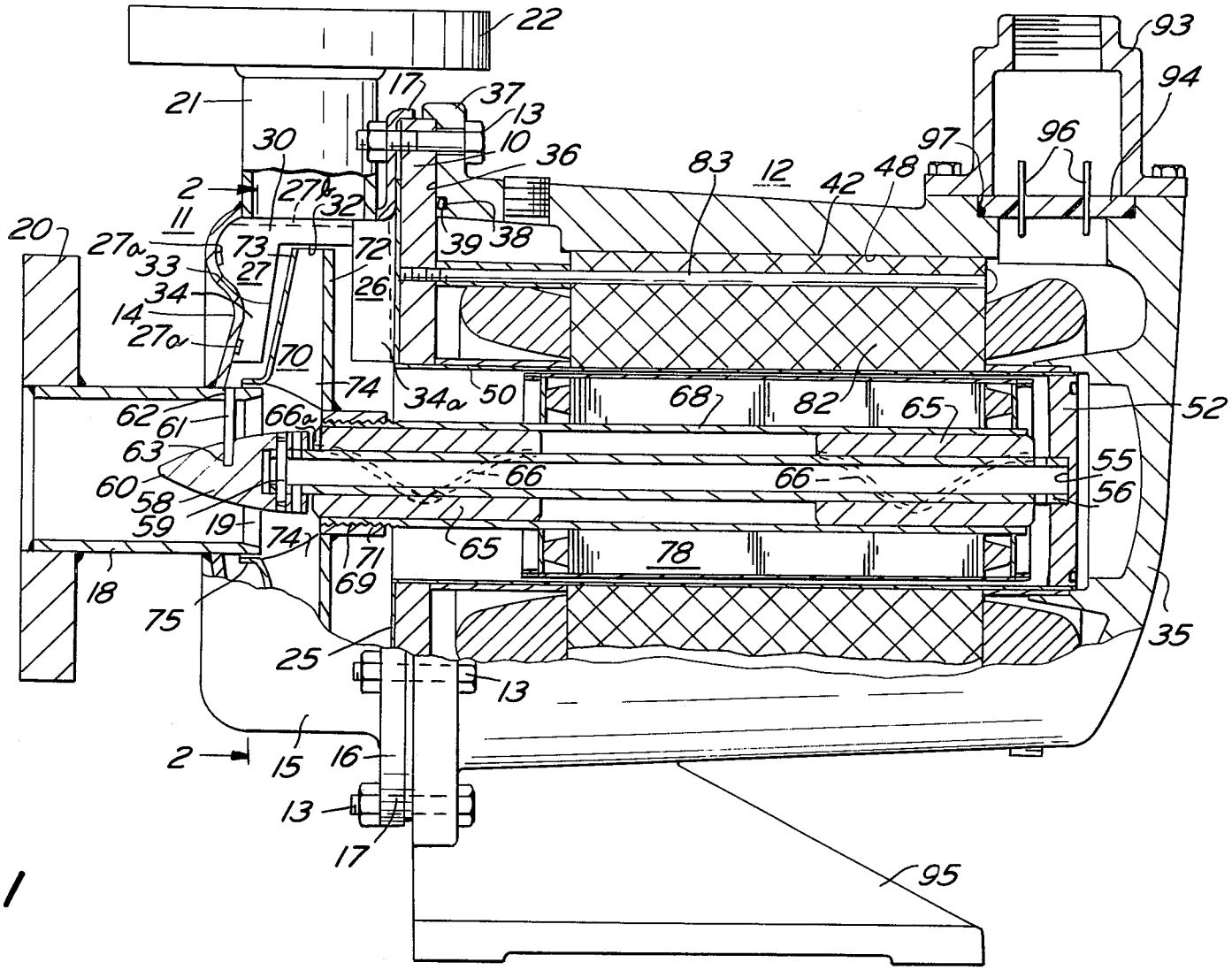
FIG. 1 is a vertical longitudinal central sectional view of a centrifugal pump in accordance with the invention.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF A PREFERRED EMBODIMENT

Referring now more particularly to the drawings, the centrifugal pump in accordance with the invention is illustrated in connection with a motor driven pump as described in my application for U.S. patent application for Motor Driven Pump, filed Jan. 27, 1975, Ser. No. 541,491, but is not restricted to use in that setting. The centrifugal pump is shown as carried by post member preferably in the form of a disc 10 to which a pump housing or casing 11 and motor stator housing 12 are secured by bolts 13. The post member 10, as will hereinafter more fully appear, can serve as a starting point or reference element and to which all the desired tolerances can be related.

The pump casing 11 is preferably circular with a dished end wall portion 14, a side wall portion 15 and an attaching flange 16 through which the bolts 13 extend. The flange 16 has a peripheral rim 17 in overlapping relation to the post 10 for positioning of the pump casing 11. The pump casing 11, because of its shape, can be made as a stamping or forging from sheet metal. A longitudinally axially disposed fluid inlet connection 18 is welded to the end wall portion and is preferably of pipe of a standard size and with an internal diameter selected in accordance with the rated fluid input. The inlet connection 18, at its inner end, can have an interior bevel 19 to facilitate fluid flow.

The pipe 18 can have a flange 20 secured thereto, as by welding, for connection to a fluid supply line (not shown).

A radially disposed fluid delivery connection 21 is welded to the side wall portion 15 and like the inlet connection 18 can be of pipe of suitable size for the fluid delivery requirements. The delivery connection 21 can be of pipe of a standard size and with an internal diameter selected in accordance with the rated fluid delivery. The pipe 21 can have a flange 22 secured thereto by welding for connection to a fluid delivery line (not shown).

A front end shroud 25 is preferably interposed between the flange 13 and the disc 10, in covering and protective relation to the outer face of the post disc 10.

A cut water plate or tongue 30 is provided, preferably composed of two plate portions 26 and 27, separable for removal and insertion of the pump impeller 70. The plate portion 26 is preferably secured to the front end shroud 25 by tabs **26*a*, and the plate portion 27 is preferably secured at its outer edge to the side wall portion 15 by a connecting strip 27*b* and to the wall portion 14 by tabs 27*a***.

Figure 2:
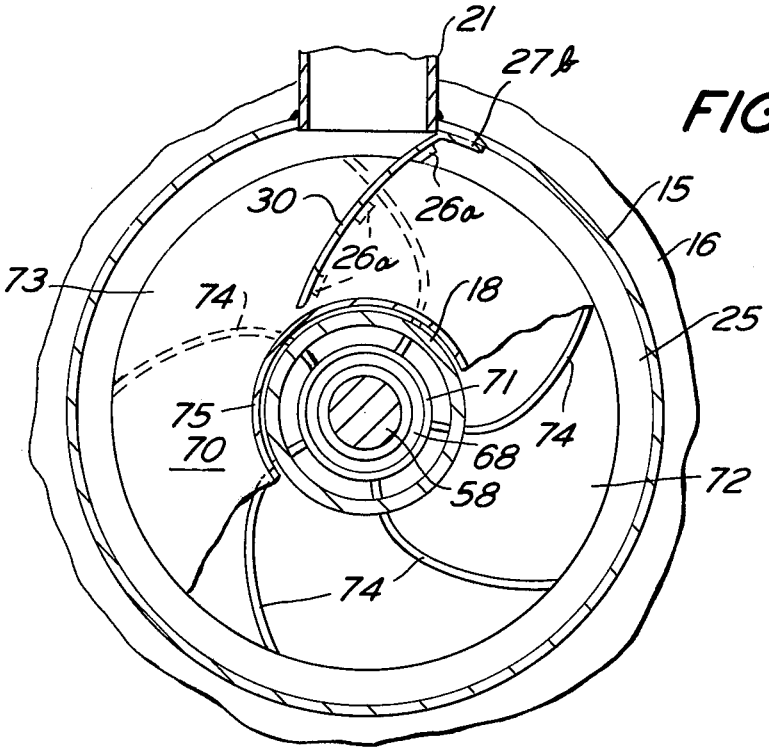
FIG. 2 is a transverse vertical sectional view taken approximately on the line 2—2 of FIG. 1 and with part of the impeller further broken away.

The cut water plate or tongue 30, between the housing side wall 15 and its terminus near the rim 75, can have a pressure-delivery curve for the highest efficiency for the collection of fluid. The cut water plate or tongue 30 is mounted at the far side of the pipe 21 and at an inclination as shown in FIG. 2. The cut water plate 30 has a central directing edge 32 at the outer extremity of a cut-out 33 with inwardly extending wing portions 34 and **34*a*** for purposes hereinafter explained.

The motor housing 12 has a closed end wall 35, preferably has an end face 36 for engagement with the post disc 10 and an overlapped peripheral rim 37 for positioning and for clamping engagement with the post disc 10. The end face 36 is provided with an end groove 38 for the reception of a packing 39, such as an O-ring, to prevent fluid leakage at this location.

The motor housing 12 has an interior space 42 within which motor stator components are disposed as explained below.

The post disc 10 is shown as having secured thereto an isolating sleeve 50 of non-mgnetic responsive material, preferably stainless steel. The shroud 25 preferably is connected to the sleeve 50 which extends through a central opening 51 in the disc 10. The opposite end of the sleeve 50 is closed by an end closure and rear shaft support plate 52, and the plate 52 has a central socket 55 for receiving the rear end of a fixedly mounted hollow shaft 56.

The shaft 56, at the front end thereof, is carried in fluid guiding inlet plug 58 and retained therein by a diametrically disposed pin 59. The inlet plug 58 has an external fluid guiding surface 60 and is preferably supported by a plurality of radial pins 61, three at 120° spacing being preferred, extending through openings 62 in the pipe 18 and into openings 63 in the plug 58.

The fixed shaft 56 has spaced bearings 65 thereon, preferably each with a helical opening 66 along the shaft 56 for liquid flow for cooling and lubrication. One bearing 65 has a slot 66a in one end face for access of liquid to the opening 66.

A hollow tubular shaft 68 to which the bearings 65 are preferably attached by shrinking has an impeller 70 secured thereto in any desired manner, such as by a collar 71 in threaded engagement with the shaft 68 at 69 and with the impeller 70 in partial overlapped relation to and supported by one of the bearings 65 for stability. The collar 71 is shown as having a shroud plate 72 welded thereto with a spaced shroud plate 73 and interposed vanes 74 secured between the plates 72 and 73. The shroud 73 preferably has a front rim 75 extending over the inner end of the pipe 17. The diameter of the impeller 70 as well as the width can be changed in accordance with the desired capacity and/or head characteristics of the impeller 70 or of the viscosity of the fluid to be handled, and a properly matched cut water plate or tongue 30 with a cut-out 33 having its edge 32 and the margins of the wings 34, 34*a*, with operational and serviceable clearances on each side to avoid interference with the impeller 70, can be readily supplied during manufacture or substituted if change of pump characteristics is desired.

The shaft 68 also is shown as having secured thereto a motor rotor 78 which is shown as of the "canned" type and shielded against interior contact by the liquid being pumped.

The housing 12, in the space 43, has a motor winding assembly 82 supported therein and held in position and against longitudinal axial movement by tie rods 83 having threaded ends engaged in the post disc 10.

The housing 12 has a connector housing 93 in holding relation to an insulating and fluid tight connector plate 94. The plate 94 engages and holds a packing ring 97 in fluid tight relation. The plate 94 has conductor pins 96 therethrough for the internal and external connection of electrical leads (not shown) for input to the stator windings 82 which are isolated from the fluid being pumped by the isolating sleeve 50.

The housing 12 can be supported in any desired manner, a base 95 being shown which forms part of the motor housing 12.

The mode of operation will now be pointed out.

Energization of the fixed windings 82 is effective for rotation of the motor rotor 78 to drive the shaft 68 and the impeller 70 mounted thereon. Fluid entering through the pipe 18 and guided by the inlet plug is delivered by the impeller 70 for delivery through the delivery pipe 21.

The post disc 10 provides a base for attachment of the pump housing 11, and for change to another pump housing if the pump impeller 70 is to be changed. The pump housing 11 is maintained in its desired position by the engagement of the side wall portion 16 and flange 17 with the bolts 13 in secured condition.

The cut-water plate 30 provides a barrier within the casing 12 so that fluid delivered outwardly by the impeller 70 into the pump casing 11 is guided by the cut water plate 30 for discharge through the fluid delivery pipe 20 with conversion of the velocity of the fluid from the impeller 70 into head. The wing portions 34, 34*a* prevent circular flow within the casing 11 thereby reducing turbulence with resultant losses. The cut water plate 30 by its ready interchangeability and with its cut-out 33 shaped to accommodate specifically different diameters and widths of impellers 70 provides variability at low cost and without loss of efficiency.

The pump structure shown can be utilized for a wide range of inputs and outputs by simple changes in components without the necessity for complete changes in the basic structure.

It will be seen that structure has been provided with which the objects of the invention are attained.

I claim:

1. A centrifugal pump for liquids comprising a pump casing having a liquid inlet connection and a liquid delivery connection communicating with the interior thereof, a rotatably mounted centrifugal liquid impeller in said pump casing with which said inlet connection is in communication, and said impeller having a plurality of impeller blades between two spaced outwardly extending shrouds and said shrouds being spaced from said pump casing, said pump casing having said inlet connection longitudinally alined with the rotational axis of said impeller, said pump casing having the interior thereof concentric with the rotational axis of said impeller, and a cut-water plate member mounted in said casing contiguous to said delivery connection for guiding liquid from said impeller and in said casing to said delivery connection, said plate member extending inwardly from the interior of the casing and having an inner edge extending transversely across the space between said shrouds at the periphery of said impeller and side wings disposed inwardly along said shrouds thereby providing a clearance opening determined by the diameter and width of the impeller and said plate defining with said casing a converging passageway toward said delivery connection.

2. The combination defined in claim 1 in which said impeller casing comprises a metal stamping.

3. A centrifugal pump as defined in claim 1 in which said cut-water plate has a portion of said clearance opening in spaced relation to the periphery of the impeller and curved side wing portions extending inwardly along the sides of said impeller.

4. A centrifugal pump as defined in claim 1 in which at least one of said fluid connections is of metal tubing welded to said impeller casing.

5. A centrifugal pump as defined in claim 1 in which said fluid inlet connection is of metal tubing and has a portion extending inwardly within said impeller casing, and said impeller has a cylindrical shroud extension in overlapped relation to said fluid inlet connection portion.

6. A centrifugal pump as defined in claim 1 in which a support is provided in said impeller casing for said impeller.

7. A centrifugal pump as defined in claim 6 in which said support is carried by the fluid inlet connection and provides a guide for fluid entering the impeller.

8. A centrifugal pump as defined in claim 1 in which said impeller casing is of circular cross section transverse to the rotational axis of the impeller and concentric with respect to said axis and has an end closure wall, said cut-water plate member has separable parts one of which is secured to the interior of said impeller casing for across to the impeller, said cut-water plate member has said side wings curved to provide said converging passageway to said delivery connection.

9. A centrifugal pump as defined in claim 1 in which said impeller casing has an end closure wall, and said cut-water plate member is of separable parts one of which is carried by said end closure wall.

* * * * *

UNITED STATES PATENT OFFICE

CERTIFICATE OF CORRECTION

Patent No. 3,967,915 Dated July 6, 1976

Inventor(s) David P. Litzenberg

It is certified that error appears in the above-identified patent and that said Letters Patent are hereby corrected as shown below:

Column 4

Line 44, before "responsive" "non-mgnetic" should be

- non-magnetic -.

Column 6

Line 60, after "for" "across" should be - access - .

Signed and Sealed this

Seventh Day of September 1976

[SEAL]

*Attest:*

RUTH C. MASON
*Attesting Officer*

C. MARSHALL DANN
*Commissioner of Patents and Trademarks*